United States Patent [19]

Leather

[11] 4,274,694

[45] Jun. 23, 1981

[54] ELECTRICAL CONNECTOR HAVING A PLURALITY OF IN-LINE CONTACTS

[75] Inventor: Russell A. Leather, Perth, Scotland

[73] Assignee: Ferranti Limited, Cheadle, England

[21] Appl. No.: 44,320

[22] Filed: May 31, 1979

[30] Foreign Application Priority Data

May 31, 1978 [GB] United Kingdom ..... 25471/78

[51] Int. Cl.[3] ..... H01R 13/62

[52] U.S. Cl. ..... 339/74 R

[58] Field of Search ..... 339/45, 74 R, 75 MP, 339/91 R, 176 MP, 207, 208, 210

[56] References Cited

U.S. PATENT DOCUMENTS

| | | | |
|---|---|---|---|
| 3,555,488 | 1/1971 | McIver et al. | 339/75 MP |
| 3,727,174 | 4/1973 | Podmore et al. | 339/210 M |
| 3,955,872 | 5/1976 | Brudy | 339/208 |
| 4,159,154 | 6/1979 | Arnold | 339/75 MP |

FOREIGN PATENT DOCUMENTS

| | | | |
|---|---|---|---|
| 1093491 | 12/1967 | United Kingdom | 339/45 M |

OTHER PUBLICATIONS

IBM Bulletin, Abbatecola, Force Free Insertion & Removal of Circuit Cards, vol. 9, No. 2, 7-1966, p. 142.

AMP Data Sheet Number 76-376, pp. 15-20 to 15-24A, 10-1976.

*Primary Examiner*—Joseph H. McGlynn

*Attorney, Agent, or Firm*—Kerkam, Stowell, Kondracki & Clarke

[57] ABSTRACT

An electric connector includes a housing (10) of elecrically-insulating material having a base (11) and two side walls (12, 13). These define a longitudinal slot (14) into which a plug member (20) may be inserted. A plurality of projecting walls (16) define a number of transverse openings (15) extending from the longitudinal slot (14), and each of these openings contains an electrically-conducting contact member (17) having a contact portion (18) which may extend into the longitudinal slot (14).

Control means are provided comprising a bar (22) located in and movable along the longitudinal slot (14), the bar being supported such that such movement causes the bar (22) to rise and fall in the slot. When the bar (22) is in its uppermost position the contact portions (18) of the contact members (17) are retracted from the longitudinal slot (14) into their respective transverse openings (15).

9 Claims, 14 Drawing Figures

20
21
14
15
13
15
16
12
18
28
29
22
17
10
11
19

ELECTRICAL CONNECTOR HAVING A PLURALITY OF IN-LINE CONTACTS

This invention relates to electrical connectors, and particularly to such connectors having a plurality of in-line contacts. Such connectors are used particularly, though not exclusively, for providing connections to printed circuit boards. They may have one or two rows of contacts, and each row may have many contacts, 90 or more being common. If a connector has two rows each having 90 contacts, then the force required to insert a board or plug into the connector is considerable.

In order to overcome this problem connectors have been made which include means for causing the contacts to be moved away from the board position whilst the board is being inserted or removed, the contacts then being moved back into position to effect the desired connections. Whilst this does not provide the same degree of wiping action sometimes relied on to keep the co-operating contact surfaces clean, the insertion force problem is thus overcome. Such connectors may be used with any form of plug member, and are not restricted to use with printed circuit boards.

It is an object of the invention to provide an electric connector having retractable in-line contacts.

According to the present invention there is provided an electric connector which includes a housing of electrically-insulating material having a base and two side walls together defining a longitudinal slot from which extend a plurality of transverse openings such that a contact portion of each contact member extends into the longitudinal slot, and control means located within the longitudinal slot and comprising a bar member capable of limited movement along the slot and supported in such a manner that such movement causes a change in the distance between the bar member and the bottom of the slot, each contact member being so shaped that movement of the bar member causes movement of each contact member into or out of its transverse opening.

The invention will now be described with reference to the accompanying drawings, in which.

Figure 1:
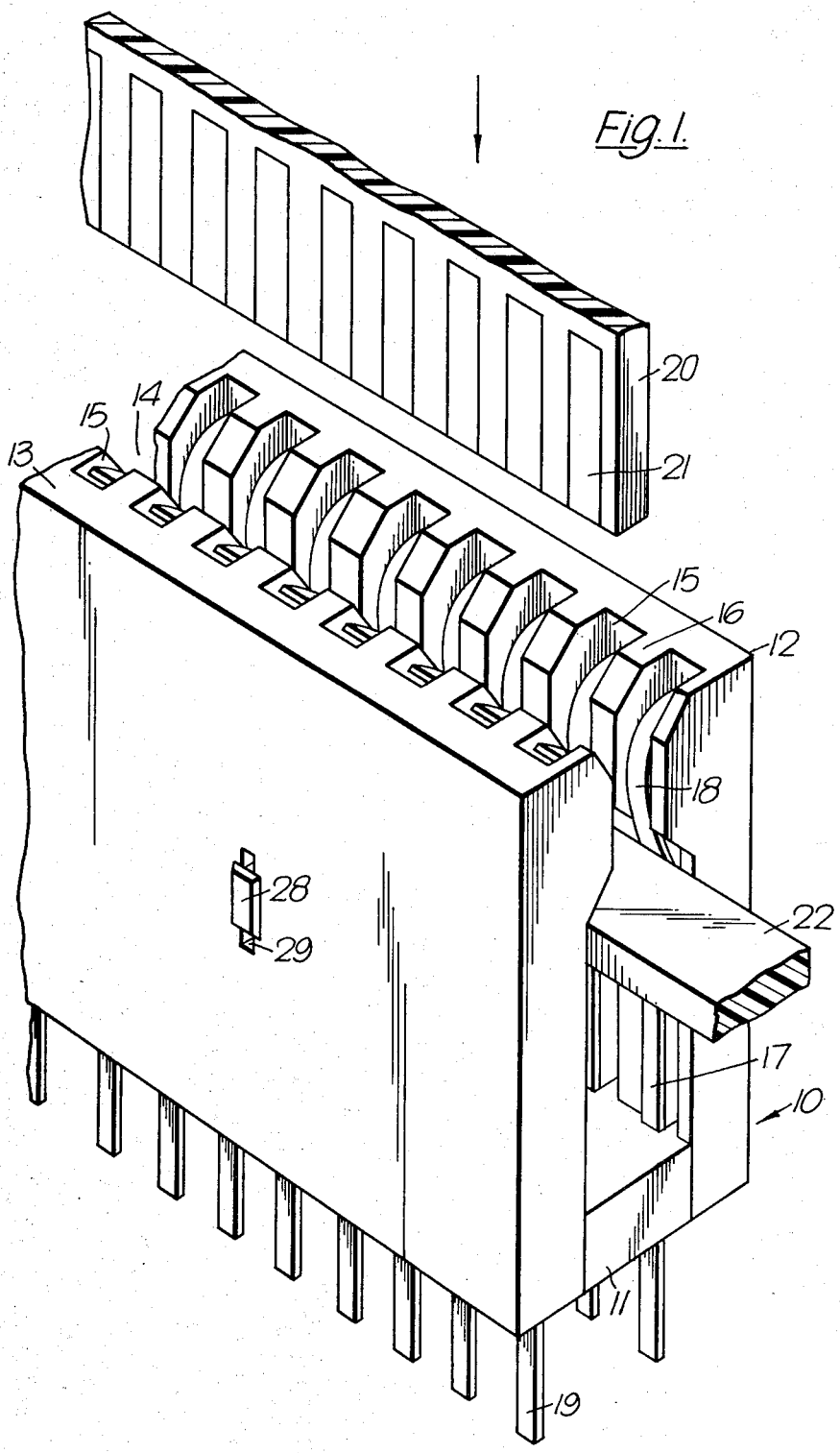
FIG. 1 is an isometric view of a connector.

Referring now to FIG. 1, the connector comprises a housing 10 of electrically-insulating material. In this example, which is an edge connector socket for use with printed circuit boards, the housing comprises a base 11 and two side walls 12 and 13 which together define a central longitudinal slot 14 from which extend a number of transverse openings 15. These openings are formed between projecting walls 16 on each side wall. Each of these transverse openings may house a contact member 17 of electrically-conducting material. Each contact member comprises a contact portion 18 and a terminal portion 19, the latter extending through the base 11 for connection to a conductor of an external circuit.

The connector so far described is very similar to many forms of edge connector into which a printed circuit board 20, having contact areas 21, may be inserted by movement in the direction of the arrow.

Located in the longitudinal slot 14 is a bar 22 which is capable of limited movement along the slot. The bar 22 is supported within the slot in such a manner that longitudinal movement in one direction increases the distance between the bar and the base of the slot, whilst movement of the bar in the opposite direction decreases the distance. This movement of the bar is arranged to control the position of the contact members. With the bar 22 in its lowest position the contact portions 18 of the contact members 17 extend into the longitudinal slot 14, whilst with the bar 22 in its uppermost position the contact portions 18 are retracted into their transverse openings 15.

FIGS. 2 to 6 illustrate a first embodiment of the invention in which the bar 22 is pivotally mounted to the base 11 of the housing 10.

Figure 2:
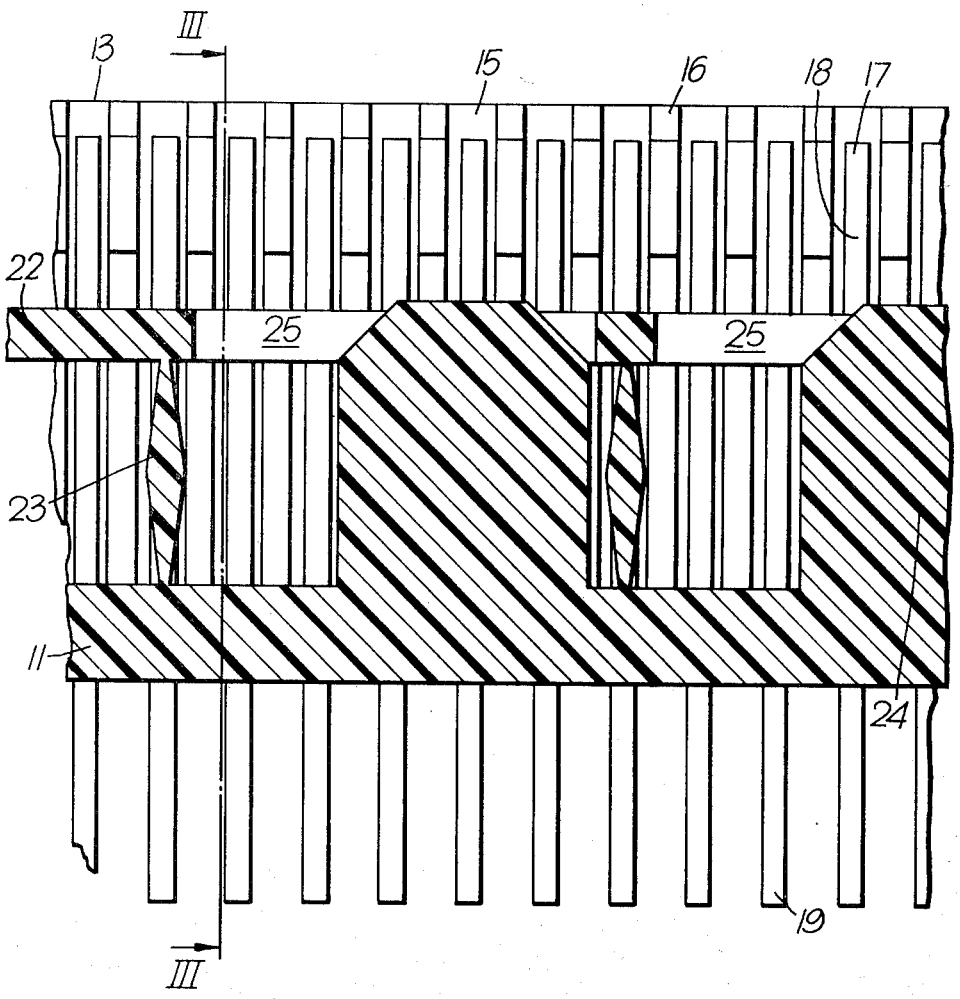
FIG. 2 is a sectional side view of part of the connector of FIG. 1 in accordance with a first embodiment.

FIG. 2 shows a sectional side view of the connector of FIG. 1 which it will be seen that the bar 22 is pivotally attached to the base 11 by means of supporting struts 23 which are connected by hinges to both the bar 22 and to the base 11. Projecting from the base 11 are a number of projecting posts 24. These act as stops to limit the insertion of a printed circuit board or plug member. Slots 25 in the bar 22 allow the bar to move past the posts, and the length of these slots may be used to limit the movement of the bar.

Figure 3:
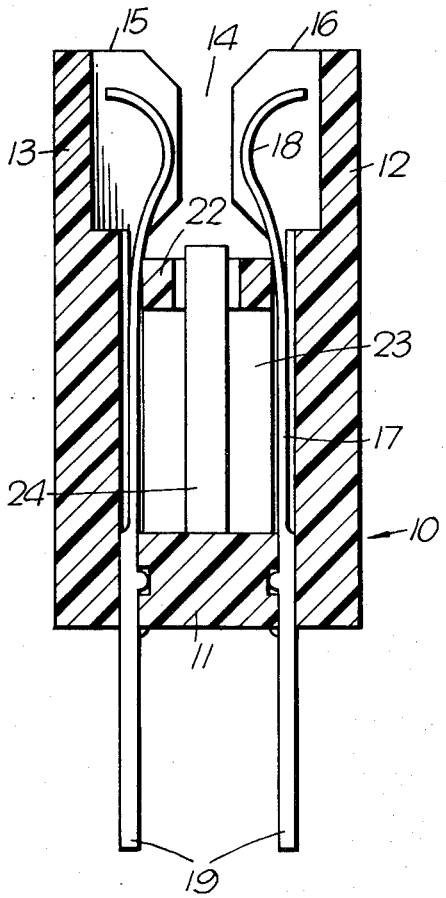
FIG. 3 is a sectional end view along the line III—III of FIG. 2.

FIG. 2 shows the bar 22 in its uppermost position, with the hinged struts 23 upright. FIG. 3 shows a sectional view along the line III—III of FIG. 2, in which the action of the bar 22 is shown. Referring now to FIG. 3, the contact members 17 are of conventional shape and in the position shown. The bar 22 presses against the upper part of each contact member and forces the contact portion 18 into its recess 15 and clear of the longitudinal slot 14. In this position a printed circuit board or other plug member may be inserted into the slot either from the top in the normal manner, or from the side. No force is required to insert the board since the contacts are retracted.

Figure 5:
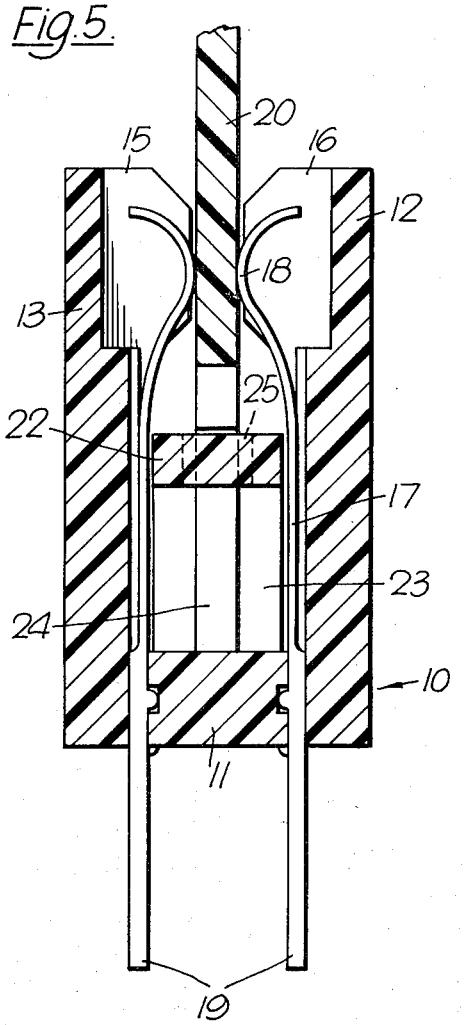
FIG. 5 is a sectional side view of the connector along the V—V of FIG. 4.
Figure 4:
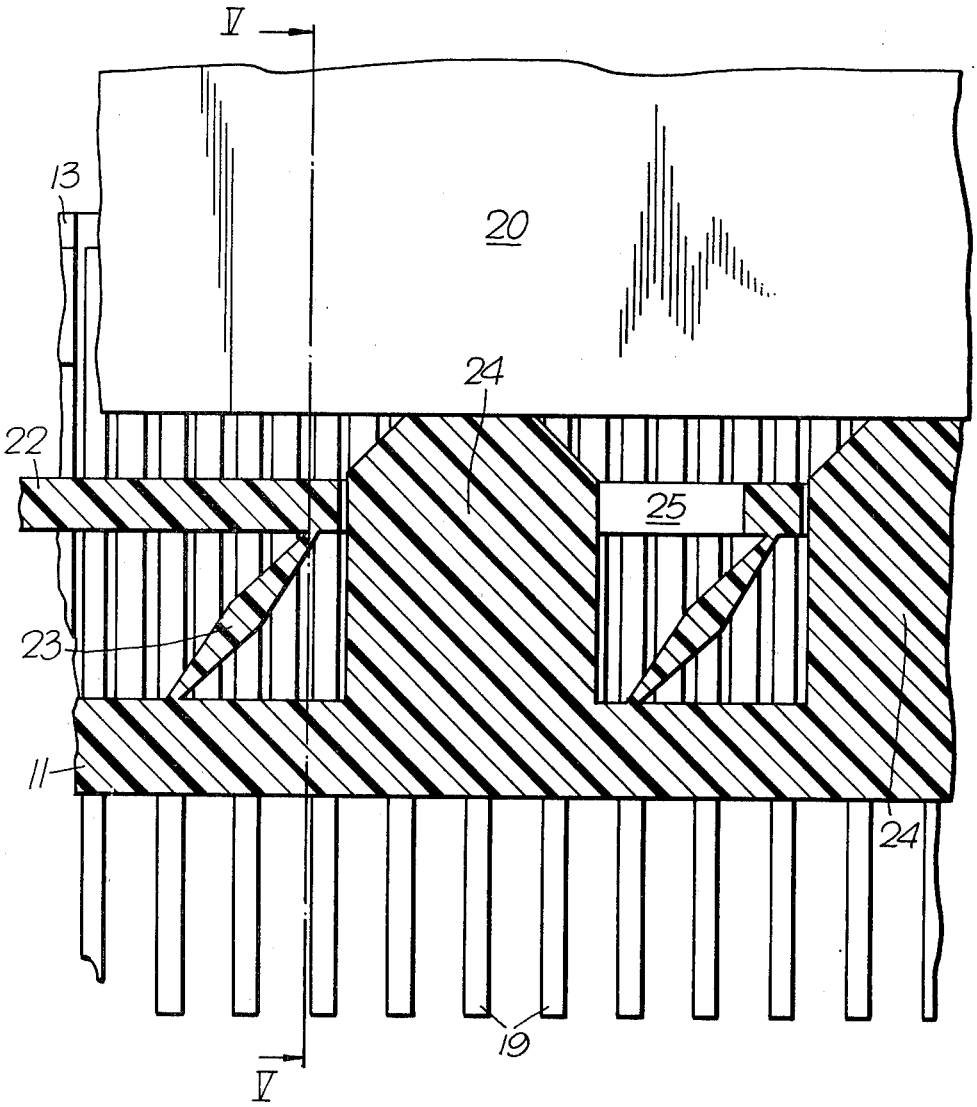
FIG. 4 is a view similar to that of FIG. 2 showing the bar member in a different position.

FIGS. 4 and 5 are side and end views respectively showing the situation when a printed circuit board has been inserted and the contacts returned to the operational position. The bar 22 is shown as having been moved to its other extreme position in which the struts 23 are inclined to the base 11 at about 45°. As a result of this movement, the bar has moved nearer to the base 11. As shown in FIG. 5 the result of this is that bar 22 no longer presses against the contact members 17, and the contact portions 18 have moved into the longitudinal slot 14 to make contact with the contact areas on the printed circuit board.

The forces exerted by the two sets of contact members which they are retracted act on the bar in opposite directions. This has the effect of reducing the overall actuating forces required, since interposing surfaces would introduce additional friction forces.

Figure 6:
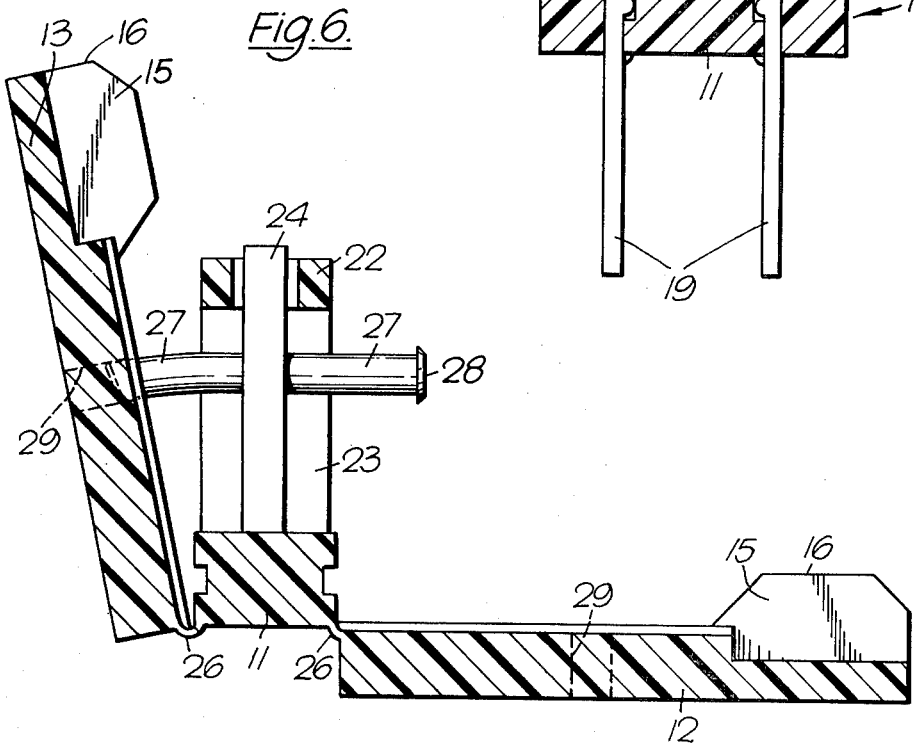
FIG. 6 is a sectional end view of a partly assembled connector.

Although the housing 10 of the connector, the bar 22 and the struts 23 may be formed separately and assembled to make the connector shown, it is possible to mould the entire assembly in one piece. FIG. 6 shows how the side walls 12 and 13 may be resiliently hinged on to the base 11 by moulded-in webs 26, and as shown in FIGS. 2 and 4 the struts may be attached to the bar 22 and base 11 in a similar manner. If this is done, then some means must be provided to secure together the base 11 and the two side walls 12 and 13 in the required position. One possible method is shown in FIGS. 1 and 6, and comprises a number of projecting pegs 27 with enlarged outer ends 28 moulded integrally with each post 24. These pegs pass through co-operating apertures 29 in the side walls 12 and 13 when the latter are folded into position, and the enlarged ends 27 of the pegs retain the side walls in position. The pegs pass through the dividing walls 16 between each transverse recess 15, and therefore do not occupy space required for contacts. If positioned above the bar, the pegs could themselves act as stops in place of the posts 24. The pegs may be secured to the side walls by other means such as welding or adhesive. The pegs could be arranged in other ways. For example they may project from one side wall and extend across the central slot to the other wall. Again, if located above the bar 22 the pegs could act as stops for the plug or board, in which case the posts 24 would not be required.

FIGS. 7 to 11 illustrate a second embodiment of the invention in which the bar 22 is slidably mounted on the base 11 of the housing 10. The same references have been used for identical parts of the connector, namely for the housing and contact members.

Figure 7:
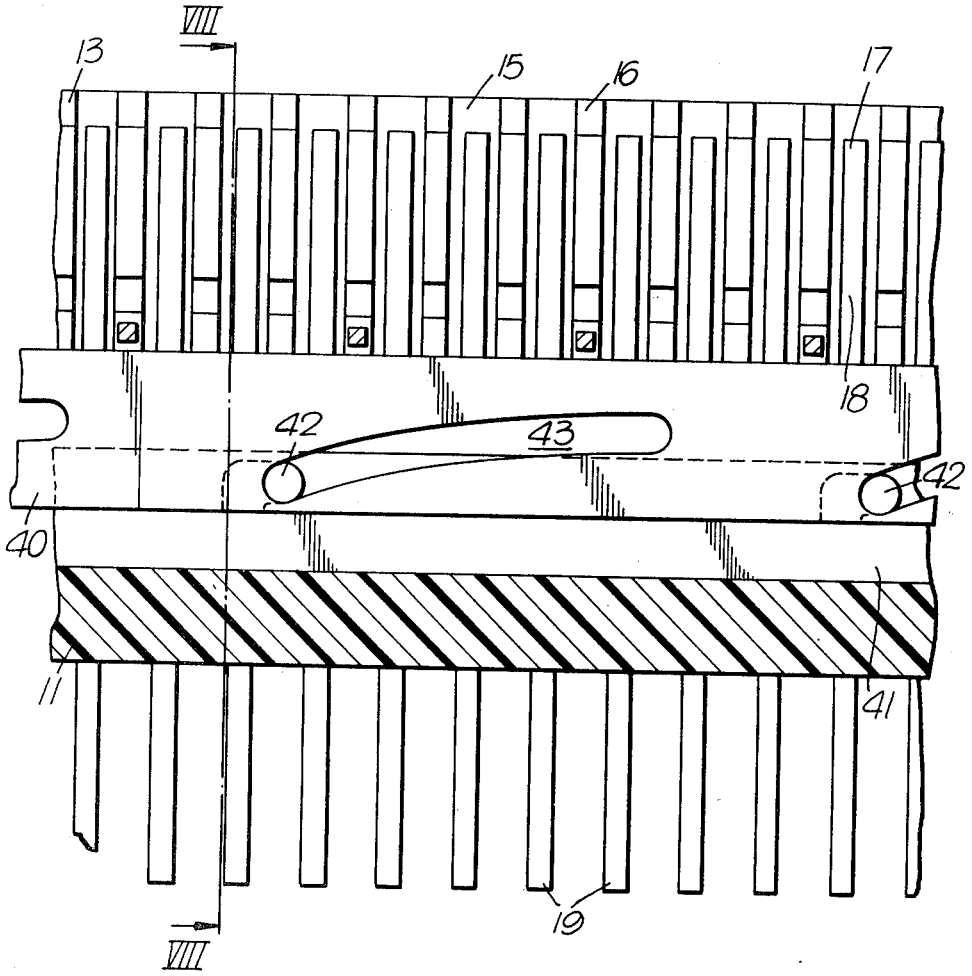
FIG. 7 is a sectional side view of part of a connector in accordance with a second embodiment.

Referring now to FIG. 7, this shows a sectional side view of the connector, with the base 11 and one side wall 13 of the housing visible, together with the transverse openings 15 separated by projecting walls 16. Contact members 17 are located in the transverse openings 15, and have contact portions 18 and terminal portions 19.

Figure 8:
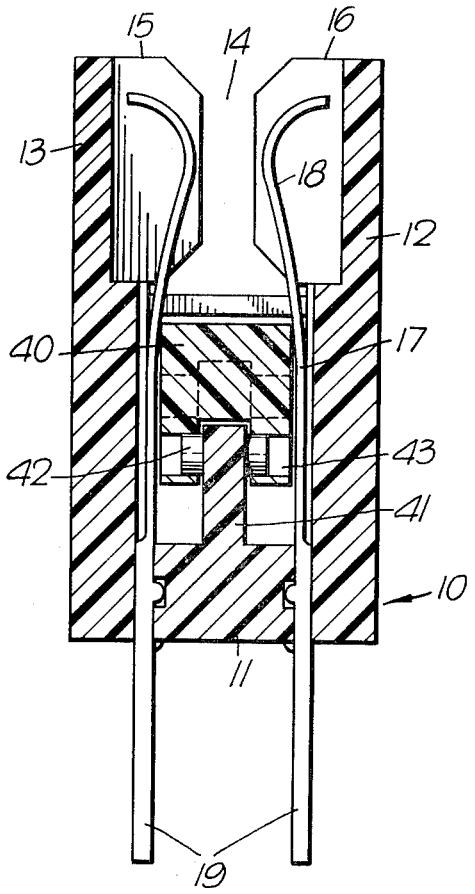
FIG. 8 is a sectional end view along the line VIII—VIII of FIG. 7.

The control means differ from that of the embodiment described above, though it still uses a bar member located in the longitudinal slot 14 of the connector. FIG. 8 shows that the bar member 40 is in fact channel-shaped, with the open end of the channel facing the base 11 of the housing. This channel fits over a central rib 41 projecting upwards from the base 11. Spaced pairs of pins 42 project from the sides of the rib 41 and engage in guide slots 43 in the sides of the bar 40. The guide slots 43 are shaped so that longitudinal movements of the bar 40 cause the distance between the bar and the base 11 of the housing to vary. FIGS. 7 and 8 show the bar in its highest position. It will be seen from FIG. 8 that when in this position the upper edges of the bar 40 cause the contact portions 18 of contact members 17 to be retracted into their recesses 15, clear of the longitudinal slot 14. In this position a printed circuit board or plug member may be inserted into the slot either from the top or from either side.

As shown in FIG. 7, the lower ends of guide slots 43 extend out of the channel. This is to enable the bar 40 to be assembled initially, and to allow for its removal if this is necessary.

Figure 9:
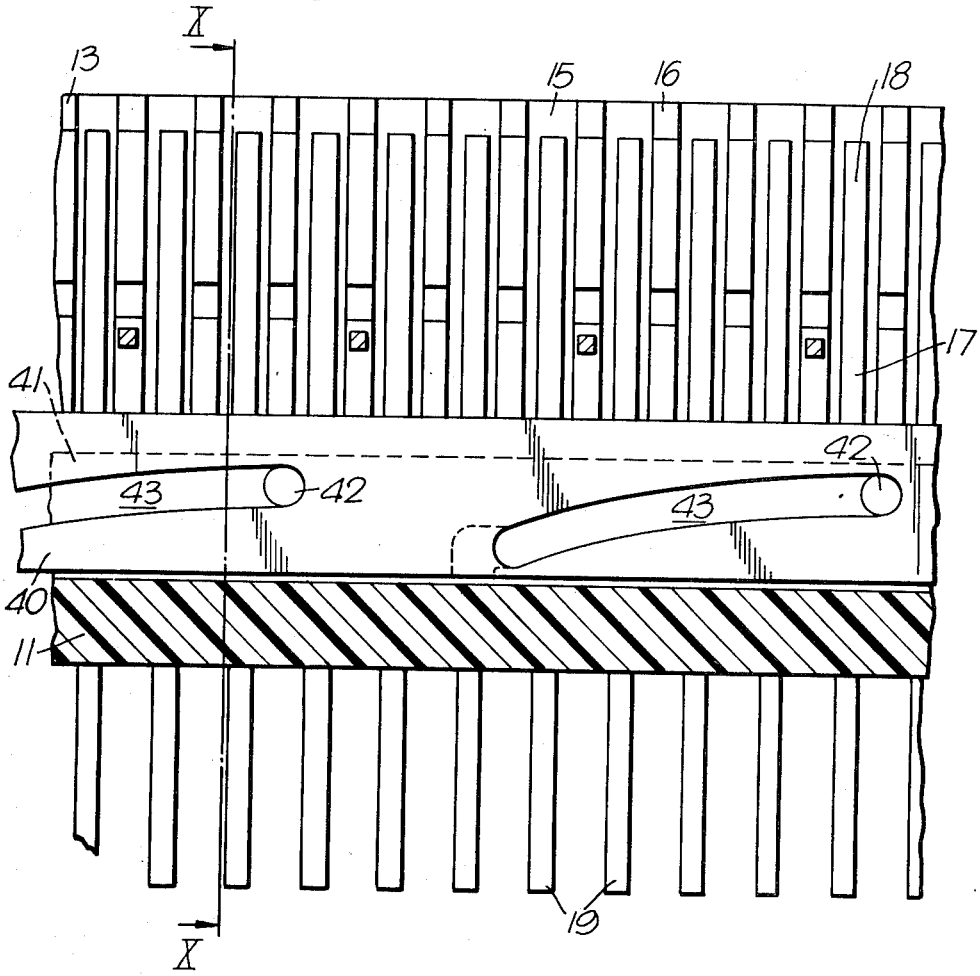
FIG. 9 is a view similar to that of FIG. 7 showing the bar member in a different position.
Figure 10:
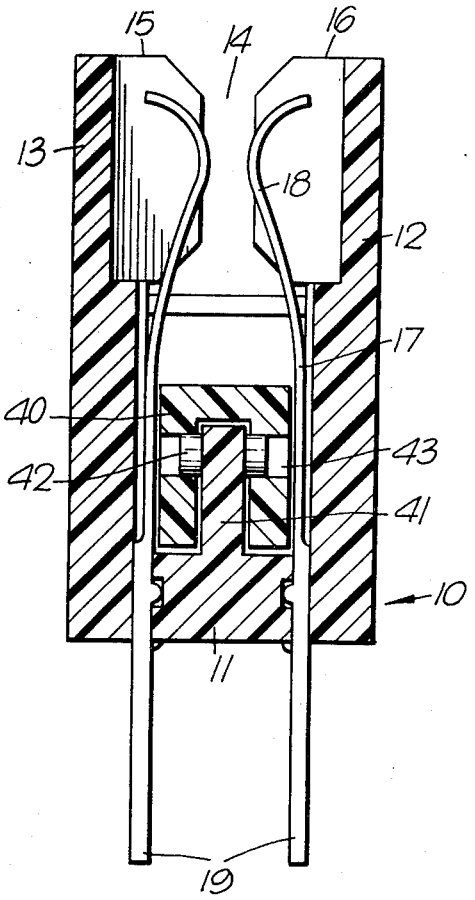
FIG. 10 is a sectional end view along the line X—X of FIG. 9.

FIGS. 9 and 10 are side and end views respectively showing the situation when the contact members 17 are returned to their operational positions, in this case without a printed circuit board in position. Movement of the bar 40 to the left of the position shown in FIG. 7 causes the bar to move closer to the base 11 of the connector, and in doing so allows the contact portions 18 of contact members 17 to move into the central longitudinal slot 14. In this position the contact members would engage with a printed circuit board if one had been inserted.

Figure 11:
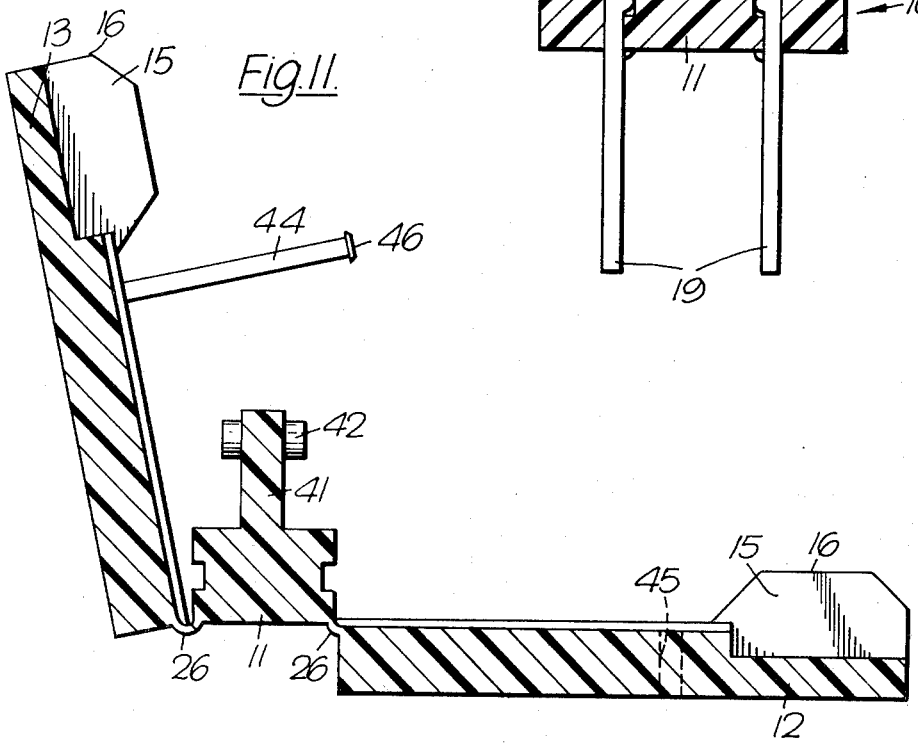
FIG. 11 is a sectional end view of a partly assembled connector.

The connector just described differs from that of the first embodiment in that it comprises two separate parts which have to be assembled. FIG. 11 shows the housing of the connector, in a similar view to that of FIG. 6, and again has the side walls 12 and 13 resiliently hinged by means of webs 26 to the base 11. The two sides walls are fastened together, after the bar 40 has been positioned on the rib 41, by means of a series of pegs 44 extending from side wall 13 and passing through apertures 45 in the opposite side wall 12. As in the previous embodiment the pegs 44 have enlarged outer ends 46 to hold them in position. The pegs act as stops to limit the insertion of a printed circuit board or plug member into the longitudinal slot 14 of the housing.

Figure 12:
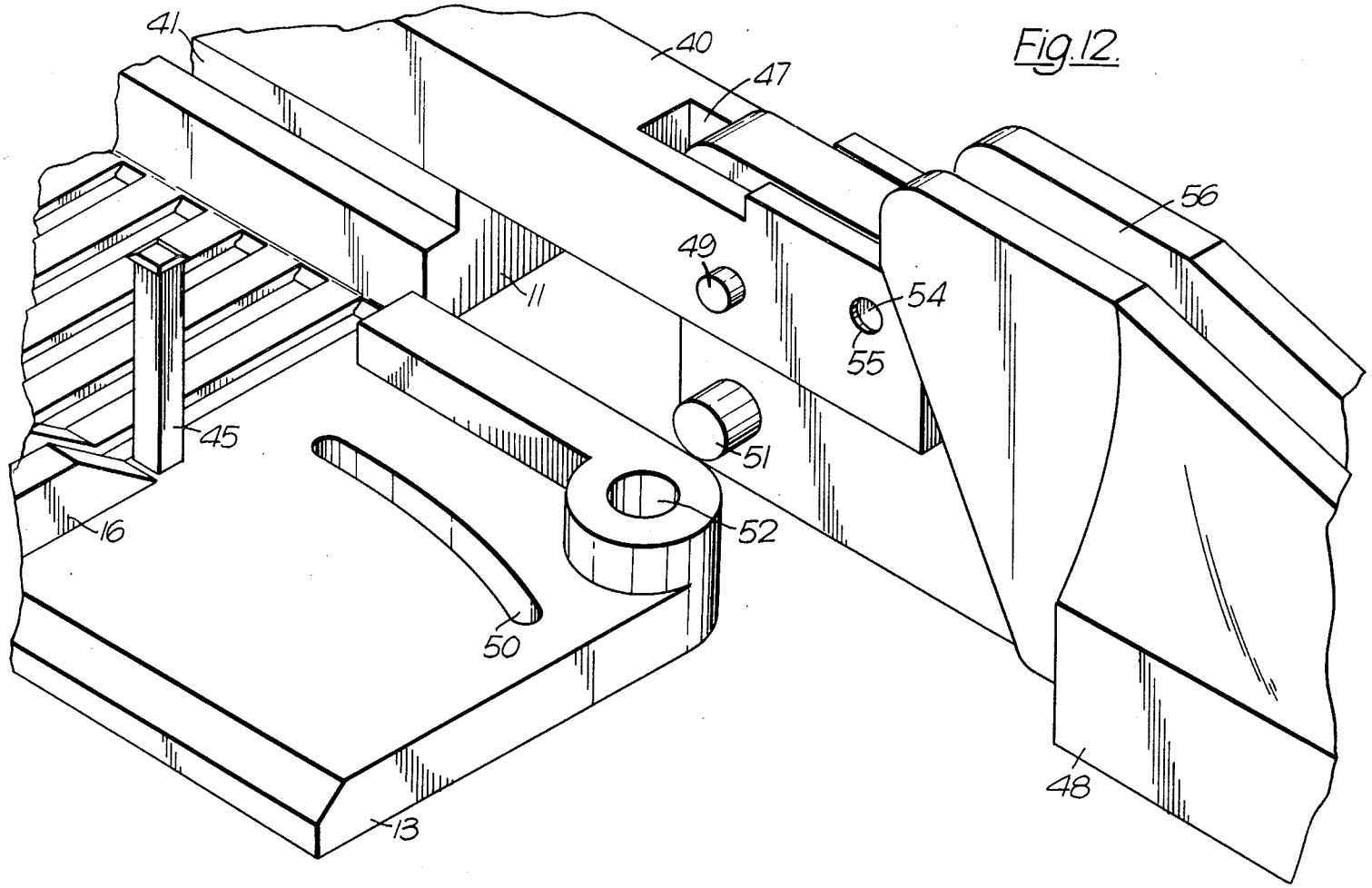
FIG. 12 is a perspective view of part of an operating mechanism for a connector.
Figure 13:
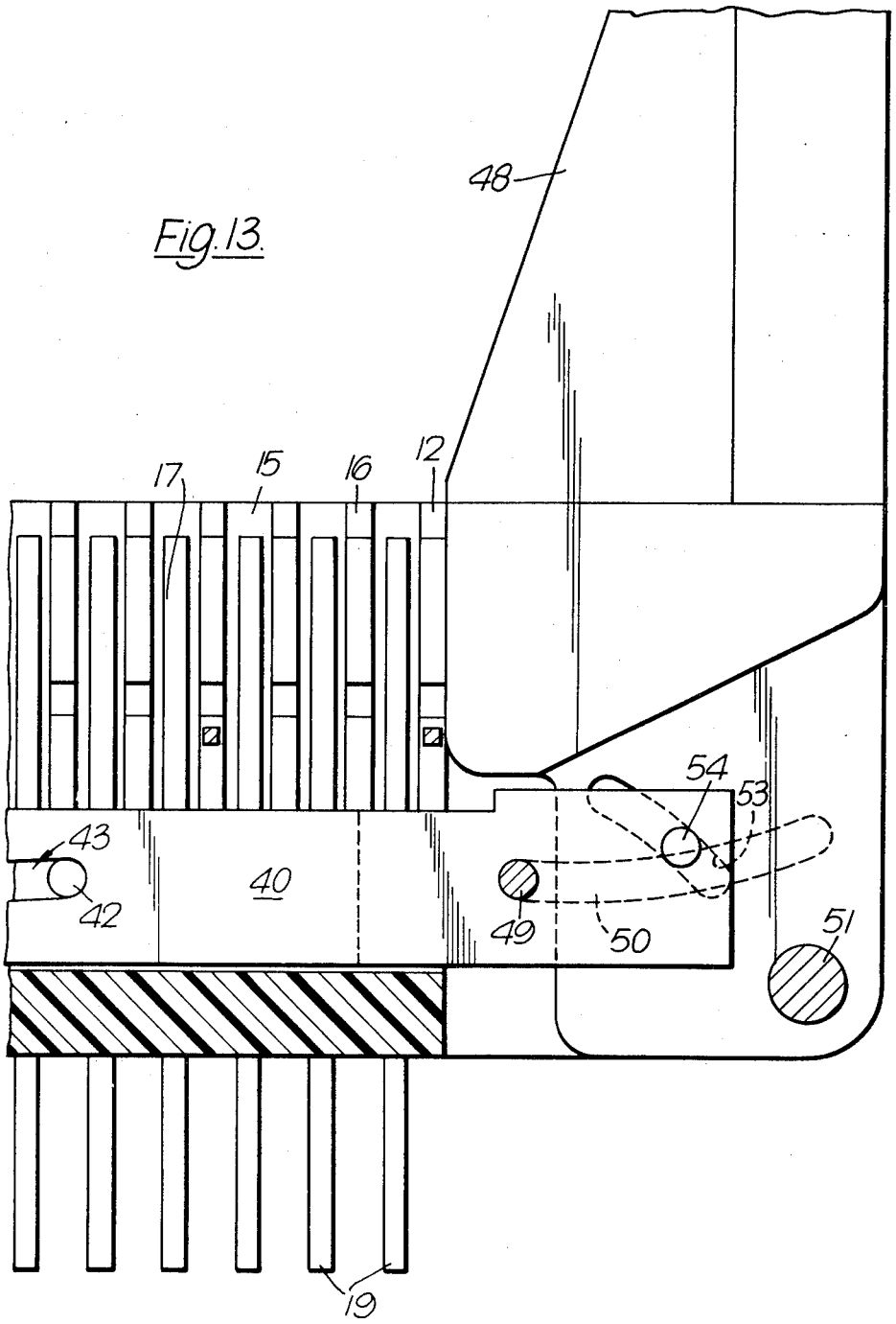
FIGS. 13 and 14 are sectional side views showing the operating mechanism in two different positions.
Figure 14:
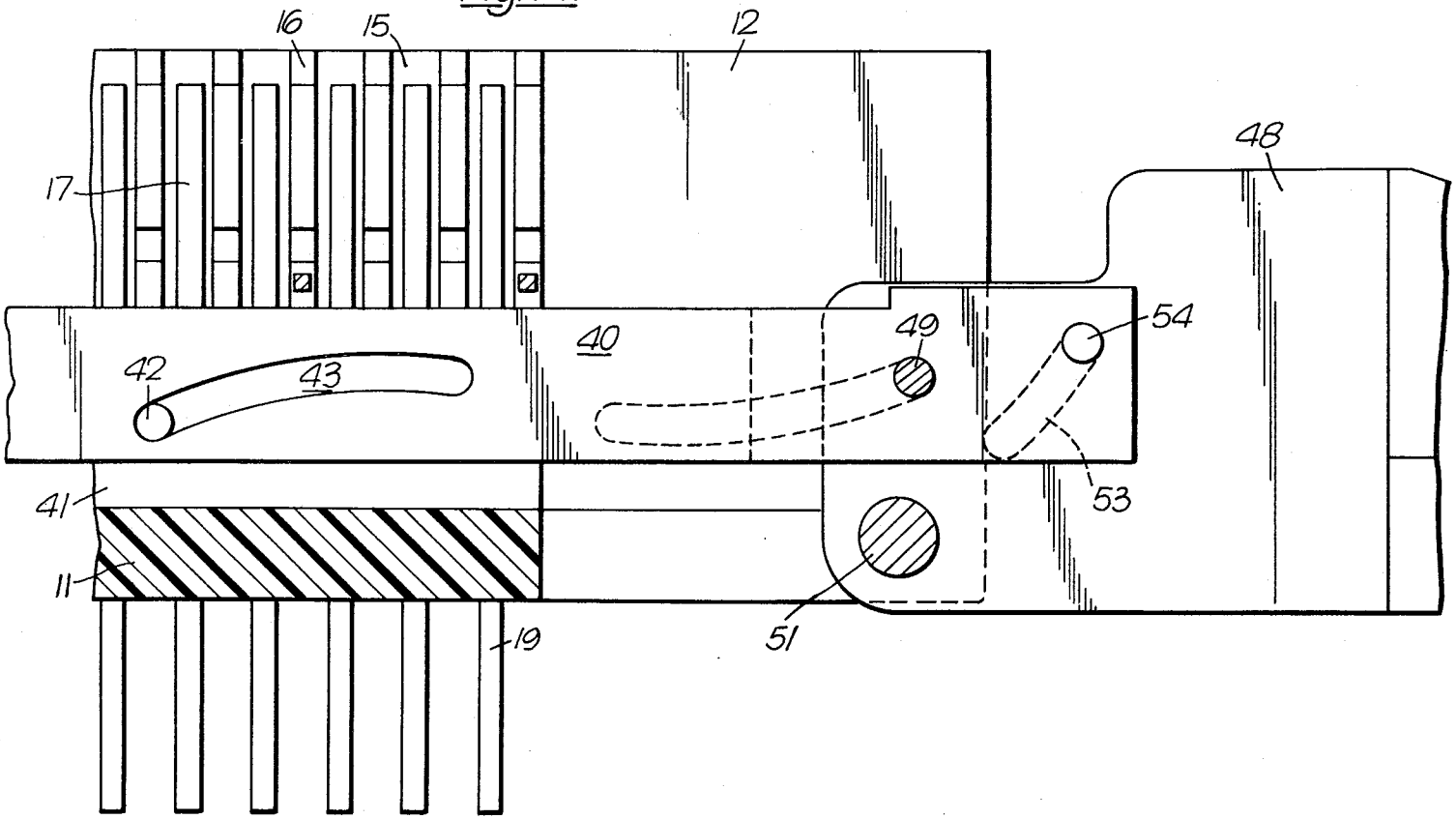

The bar 22 or 40 requires to be moved longitudinally in order to retract or extend the contact members, and some means must be provided for doing this. In its simplest form the operating means may be an enlarged end on the bar which may be gripped easily by the fingers so that the bar may be pulled. If the housing contains a large number of contacts, or if a number of connectors are arranged in line with their bars connected together, it may be necessary to provide a lever or some other operating mechanism which will exert sufficient force to move the contacts. FIGS. 12 to 14 illustrate an operating mechanism which may be used with either form of connector described, though the following description relates to the embodiment of FIGS. 7 to 11.

Referring first to FIG. 12, this shows part of an operating mechanism and the associated parts of the connector, in a perspective view of the base 11 and one side 13 of the housing. The drawing shows the base 11, part of rib 41 and one end of the bar 40. Part of side wall 13 of the housing, with its projecting walls 16 is also shown. The side wall 13 is extended beyond the transverse recesses to provide support for the operating mechanism, as will be described below. The other side wall 12, which is omitted from FIG. 12, is extended in the same way as wall 13.

The end of the bar 40 carries a slot 47 in which is located an operating lever or handle 48. Each side of bar 40, adjacent to the slot 47 carries a projecting pin 49 which engages a curved groove 50 formed in the extended part of the side wall 13 (and in wall 12). The shape of the groove 50 is derived from the locus of a point on the bar 40 when a slot 43 in the bar moves about a pin 42 on the rib 41. Each side of lever 48 carries a projecting fulcrum pin 51 which fits into holes 52 in the extended side walls. The lever 48 has a curved slot 53 (see FIGS. 13 and 14) formed in it through which passes a pin 54 located in holes 55 on either side of the slot 47 in bar 40.

FIG. 13 shows a sectioned side view of the operating mechanism with the contacts in the operative position.

The bar 40 is in its lowest position, and pin 49 on the handle 48 is located at one end of the groove 50. In this position the handle is at right angles to the housing, and may be formed with a slot 56 (see FIG. 12) which allows access for the printed circuit board, as well as aiding its location.

As the lever 48 is moved from the position shown in FIG. 13 to that shown in FIG. 14, it pivots about the pins 51. Pin 54 moves in the slot 43 in handle 48 and causes the bar 40 to move to the right, the bar rising as it does so due to the effect of pin 49 moving in slot 50.

The curve of slot 53 is chosen so that the force applied to the lever 48 to actuate the contacts is distributed as evenly as possible over the 90° range of movement of the handle 48.

The above is just one example of a suitable operating mechanism, and many other types of mechanism may be used.

As already stated the invention is not restricted to connectors for use with printed circuit boards, but may be used in any situation in which a plug member has to be used with a connector having a number of in-line contacts.

What we claim is:

1. An electrical connector which includes a housing of electrically-insulating material having a base and two side walls together defining a longitudinal slot from which extend a plurality of transverse openings, a plurality of electrically-conducting contact members located one in each of at least some of the transverse openings such that a contact portion of each contact member extends into the longitudinal slot, and control means located within the longitudinal slot and comprising a rigid bar member capable of limited movement along the slot and supported in such a manner that such movement causes a change in the distance between the bar member and the bottom of the longitudinal slot, each contact member being so shaped that movement of the bar member causes movement of each contact member into or out of its transverse opening.

2. An electrical connector which includes a housing of electrically-insulating material having a base and two side walls together defining a longitudinal slot from which extend a plurality of transverse openings, a plurality of electrically-conducting contact members located one in each of at least some of the transverse openings such that a contact portion of each contact member extends into the longitudinal slot, and control means located within the longitudinal slot and comprising a rigid bar member capable of limited movement along the slot and supported in such a manner that such movement causes a change in the distance between the bar member and the bottom of the longitudinal slot, each contact member being so shaped that movement of the bar member causes movement of each contact member into or out of its transverse opening in which the bar member is secured to the base of the housing by means of hinged struts.

3. A connector as claimed in claim 2 in which the hinged struts are formed integrally with the bar member and the base of the housing.

4. A connector as claimed in claim 2 which includes stop means operable to limit the longitudinal movement of the bar member.

5. A connector as claimed in claim 4 in which the stop means comprise a number of posts projecting from the base of the housing.

6. A connector as claimed in claim 5 in which the posts pass through slots in the bar member.

7. An electrical connector which includes a housing of electrically-insulating material having a base and two side walls together defining a longitudinal slot from which extend a plurality of transverse openings, a plurality of electrically-conducting contact members located one in each of at least some of the transverse openings such that a contact portion of each contact member extends into the longitudinal slot, and control means located within the longitudinal slot and comprising a rigid bar member capable of limited movement along the slot and supported in such a manner that such movement causes a change in the distance between the bar member and the bottom of the longitudinal slot, each contact member being so shaped that movement of the bar member causes movement of each contact member into or out of its transverse opening in which the control means includes a rib projecting from the base member and having pegs projecting from the two opposite sides thereof, the bar member being in the form of a channel-shaped member inverted over the rib and having guide slots formed in it in which the pegs are located, the guide slots being shaped such that longitudinal movement of the bar member causes a change in the distance between the bar member and the bottom of the longitudinal slot.

8. A connector as claimed in claim 7 in which longitudinal movement of the bar member is limited by the dimensions of the guide slots.

9. A connector as claimed in claim 7 in which securing means for fastening the side walls and the base comprises projecting pegs carried by posts extending from the base by passing through cooperating apertures in each side wall.

* * * * *